US009840014B2

(12) United States Patent
Gilor

(10) Patent No.: US 9,840,014 B2
(45) Date of Patent: Dec. 12, 2017

(54) SAFETY RAZOR

(71) Applicant: Avraham Gilor, San Diego, CA (US)

(72) Inventor: Avraham Gilor, San Diego, CA (US)

( * ) Notice: Subject to any disclaimer, the term of this patent is extended or adjusted under 35 U.S.C. 154(b) by 0 days.

(21) Appl. No.: 15/081,386

(22) Filed: Mar. 25, 2016

(65) Prior Publication Data

US 2017/0274541 A1 Sep. 28, 2017

(51) Int. Cl.
*B26B 21/44* (2006.01)
*B26B 21/18* (2006.01)

(52) U.S. Cl.
CPC ..... *B26B 21/443* (2013.01); *B26B 21/18* (2013.01)

(58) Field of Classification Search
CPC ..... B26B 21/18; B26B 21/443
USPC ..... 30/41, 41.5, 51–54
See application file for complete search history.

(56) References Cited

U.S. PATENT DOCUMENTS 979,296 A * 12/1910 Heissenberger ..... B26B 21/446 30/41
1,288,869 A * 12/1918 Ganzhorn ..... B26B 21/446 30/41
1,444,764 A * 2/1923 Rohde et al. ..... B26B 21/34 30/41
1,453,014 A * 4/1923 Kohn ..... A46B 15/0055 30/41
1,633,139 A * 6/1927 Staats-oels ..... B26B 21/22 30/50
1,741,891 A * 12/1929 Vallon ..... B26B 21/44 30/41
1,744,902 A * 1/1930 Johnston ..... B26B 21/44 30/41
1,825,335 A * 9/1931 Connolly ..... B26B 21/34 30/41
1,892,836 A * 1/1933 Harvey ..... B26B 21/446 30/41
1,920,711 A * 8/1933 Pelizzola ..... B26B 21/22 30/50
1,923,439 A * 8/1933 Hukill ..... B26B 21/22 30/50
1,935,452 A * 11/1933 Kondolf ..... B26B 21/185 30/73
1,975,757 A * 10/1934 Gray ..... B26B 21/18 30/52
2,040,345 A * 5/1936 Taylor ..... B26B 21/40 30/34.2
2,120,940 A * 6/1938 Minassian ..... B26B 21/44 30/41
2,292,418 A * 8/1942 Wetherbee ..... B26B 21/44 30/41

(Continued)

FOREIGN PATENT DOCUMENTS

DE 630053 C * 5/1936 ..... B26B 21/18
DE 679564 C * 8/1939 ..... B26B 21/18

(Continued)

*Primary Examiner* — Jason Daniel Prone
(74) *Attorney, Agent, or Firm* — Klarquist Sparkman, LLP

(57) ABSTRACT

A safety razor includes a handle portion and a head portion that is removably coupled to the handle. The head portion includes a guard member, a replaceable blade member, a replaceable lubrication member that has a lubrication substance applied or attached thereto, and a cap member. The blade member and the lubrication member are independently removable and replaceable relative to each other and the head portion.

11 Claims, 12 Drawing Sheets

(56) References Cited

U.S. PATENT DOCUMENTS 2,299,868 A * 10/1942 Younghusband ..... B26B 21/18 30/41
2,313,895 A * 3/1943 Savary ..... B26B 21/18 30/71
2,319,980 A * 5/1943 Des Jardins ..... B26B 21/22 30/346.56
2,327,967 A * 8/1943 Peters ..... B26B 21/18 30/77
2,336,806 A * 12/1943 Schenk et al. ..... B26B 21/44 239/136
2,363,040 A * 11/1944 Barthalot ..... B26B 21/18 30/41
2,374,612 A * 4/1945 Mellon ..... B26B 21/18 30/41
2,375,444 A * 5/1945 Schwartz ..... B26B 21/44 30/41
2,389,470 A * 11/1945 Traynham ..... B26B 21/18 30/41
2,392,975 A * 1/1946 Cooney ..... B26B 21/446 30/41
2,548,959 A * 4/1951 Eisenberg et al. ..... B26B 21/18 30/34.2
2,568,047 A * 9/1951 Anderson ..... B26B 21/34 30/34.2
2,593,306 A * 4/1952 Jacobsen ..... B26B 21/18 30/346.61
2,593,307 A * 4/1952 Jacobsen ..... B26B 21/18 30/52
2,677,883 A * 5/1954 Schallgruber ..... B26B 21/44 30/41
2,698,995 A * 1/1955 Anastasia ..... B26B 21/32 30/60.5
2,766,521 A * 10/1956 Benvenuti ..... B26B 21/34 30/82
2,837,820 A * 6/1958 Ostrowski ..... B26B 21/16 30/51
2,861,338 A * 11/1958 Boland ..... B26B 21/44 30/41
3,138,865 A * 6/1964 Meyer ..... B26B 21/40 30/41
3,139,683 A * 7/1964 Waldman ..... B26B 21/446 30/41
3,417,468 A * 12/1968 Miyauchi ..... B26B 21/446 30/41
3,477,127 A * 11/1969 Regan ..... B26B 19/40 30/41
3,768,161 A * 10/1973 Miller ..... B26B 21/44 30/41
3,777,396 A * 12/1973 Simonetti ..... B26B 21/22 30/50
3,802,072 A * 4/1974 Wintercorn ..... B26B 21/34 30/81
3,895,437 A * 7/1975 DiBuono ..... B26B 21/44 30/41
3,969,817 A * 7/1976 DiBuono ..... B26B 21/44 30/41
4,170,821 A * 10/1979 Booth ..... B05D 5/08 30/41
4,189,832 A * 2/1980 Harper ..... B26B 21/20 30/34.2
4,314,404 A * 2/1982 Ruiz ..... B26B 21/446 30/41
4,562,644 A * 1/1986 Hitchens ..... B26B 21/44 30/41
4,641,429 A * 2/1987 Abatemarco ..... B26B 21/4012 30/41
4,872,263 A * 10/1989 Etheredge, III ..... B26B 21/443 30/41
5,036,587 A * 8/1991 Trotta ..... B26B 21/44 30/41
5,095,620 A * 3/1992 Althaus ..... B26B 21/443 30/41
5,430,939 A * 7/1995 Johnston ..... B26B 21/443 30/41
5,454,164 A * 10/1995 Yin ..... B26B 21/443 30/41
5,590,468 A * 1/1997 Prochaska ..... B26B 21/22 30/41
6,532,667 B1 * 3/2003 Leaseburge ..... B26B 21/443 30/41
6,993,846 B2 2/2006 Orloff
9,505,142 B2 * 11/2016 Nordstrom ..... B26B 21/18 30/32
2015/0107114 A1 * 4/2015 Minsk ..... B26B 21/44 30/41
2015/0352737 A1 * 12/2015 Hickam ..... B26B 21/521 30/70
2016/0250761 A1 * 9/2016 Zoller ..... B26B 21/4012 30/34.05
2017/0297212 A1 * 10/2017 Nordstrom ..... B26B 21/521 30/71

FOREIGN PATENT DOCUMENTS

DE 862273 C * 1/1953 ..... B26B 21/18
DE 863917 C * 1/1953 ..... B26B 21/18
DE 870214 C * 3/1953 ..... B26B 21/18
DE 102013010990 A1 * 1/2015 ..... B26B 21/18
FR 860727 A * 1/1941 ..... B26B 21/18
GB 155450 A * 12/1920 ..... B26B 21/18
GB 147695 A * 4/1921 ..... B26B 21/18
GB 153279 A * 8/1921 ..... B26B 21/18
GB 396541 A * 8/1933 ..... B26B 21/18
WO WO 2016207677 A1 * 12/2016 ..... B26B 21/18

* cited by examiner

SAFETY RAZOR

FIELD

The present disclosure generally concerns safety razors, and more particularly, lubrication devices and systems for safety razors.

BACKGROUND

Safety razors are shaving devices that typically have a handle, a single, replaceable blade, and a protective guard positioned adjacent an edge of the blade to protect a user's skin from full exposure to the edge of the blade. Safety razors were developed as a relatively safer and/or easier to use alternative to straight edge razors. There are various types of blades for safety razors including single-edge and double-edge blades.

Although safety razors have been around for over a hundred years, disposable razors (including cartridge razors) are the most commonly used type of razors today. Nevertheless, in recent years, safety razors are regaining popularity due to, inter alia, long term cost savings over disposable razors because replacement blades for safety razors are relatively inexpensive.

Despite regaining popularity, safety razors have remained essentially unchanged for many years. As a result, there is a continuing need for improved safety razors.

SUMMARY

Described herein are embodiments of safety razors, as well as lubrication devices and systems for safety razors, comprising at least one lubrication member. These lubrication members can be used to lubricate a user's skin while shaving and to reduce friction and skin irritation caused by a blade during shaving.

In one representative embodiment, a safety razor comprises a handle portion having a first end portion and a second end portion and a longitudinal axis extending from the first end portion to the second end portion, and a head portion that is removably coupled to the first end portion of the handle and includes a guard member, a replaceable blade member having at least one cutting edge portion, a replaceable lubrication member comprising a lubrication substance, and a cap member having a projection that is configured to extend through the lubrication member, the blade member, and the guard member and to extend into the handle portion, wherein the lubrication member, the blade member, and the guard member have centrally disposed openings through which the projection of the cap member extends, and wherein the blade member and the lubrication member are independently removable and replaceable relative to each other and the head portion.

In some embodiments, the lubrication member is relatively rigid such that the lubrication member maintains its shape when a user presses the lubrication member against the user's skin. In some embodiments, wherein the lubrication member has a rounded edge portion that extends laterally beyond the cap member, and the lubricating substance disposed on the rounded edge portion of the lubrication member.

In some embodiments, the lubricating substance is a lubricating coating that is applied to a portion of the lubrication member. In other embodiments, the lubricating substance is a lubricating strip that is attached to a portion of the lubrication member.

In some embodiments, the head portion is removably coupled to the handle portion such that the at least one cutting edge of the blade member is perpendicular to the longitudinal axis of the handle portion, and the lubrication member has a lubricating edge portion that is parallel to the at least one cutting edge portion of the blade member and to which the lubricating substance is applied or attached.

In some embodiments, the blade member has a first cutting edge portion disposed on a first side portion of the blade member and a second cutting edge portion disposed on a second side portion of the blade member, and the head portion is removably coupled to the handle portion such that the first and the second cutting edge portions are perpendicular to the longitudinal axis of the handle portion, and wherein the lubrication member has a first edge portion disposed on a first side portion of the lubrication member and a second edge portion disposed on a second side portion of the lubrication member, and the first and the second edge portions of the lubrication member are parallel to the first and the second cutting edge portions of the blade member.

In some embodiments, the head portion further includes a spacer member having a centrally disposed opening through which the projection of the cap member can extend, wherein the spacer is disposed between the blade and the lubrication member and is configured to space the lubrication member and the blade member relative to each other along an axis extending through the central openings of the blade member and the lubrication member.

In some embodiments, the lubrication member is a first lubrication member that is disposed between the cap member and the blade member, and the head portion further comprises a second lubrication member that is disposed the guard member and the handle portion and that has a centrally disposed opening through which the projection of the cap member can extend. In some of those embodiments, the first and the second lubrication members and the blade member are independently removable and replaceable relative to each other and the head portion. In some of those embodiments, the first lubrication member extends laterally past the cap member, and the second lubrication member extends laterally beyond the guard member.

In some embodiments, the lubrication member is a plurality of lubrication members and at least two of the lubrication members are disposed the handle portion and the cap member of the head portion.

In another representative embodiment, a lubrication system for a safety razor is provided. The lubrication system comprises a spacer member, a replaceable lubrication member, and a lubricating substance which is applied or attached to the lubrication member, wherein the spacer member and the lubrication member have centrally disposed openings configured to removably receive a portion of a safety razor.

In some embodiments, the lubrication member is a first lubrication member, and the lubrication system further comprises a second lubrication member, wherein the lubricating substance is applied or attached to the first and the second lubrication members, and the first and the second lubrication members have centrally disposed openings, configured to removably receive a portion of a safety razor.

In another representative embodiment, a method of replacing a lubrication member is provided. The method comprises detaching a handle portion of safety razor from a head portion of the safety razor, decoupling a lubrication member from a blade member, coupling a new lubrication member to the head portion, reattaching the head portion to the handle portion.

In some embodiments, the new lubrication member is coupled to the head portion between the blade member and a cap member. In other embodiments, the new lubrication member is coupled to the head portion between the blade member and the handle portion.

In some embodiments, the step of decoupling the lubrication member from the blade member includes removing a projection of a cap member from a centrally disposed opening in the lubrication member.

In some embodiments, the lubrication member is a first lubrication member and the new lubrication member is a first new lubrication member, and the method further comprises decoupling a second lubrication member from the blade member and coupling a second new lubrication member to the head portion. In some of those embodiments, the first lubrication member is coupled to the head portion between the blade member and the handle portion, and the second lubrication member is coupled to the head portion between the blade member and a cap member.

The foregoing and other objects, features, and advantages of the invention will become more apparent from the following detailed description, which proceeds with reference to the accompanying figures.

DETAILED DESCRIPTION

Figure 1:
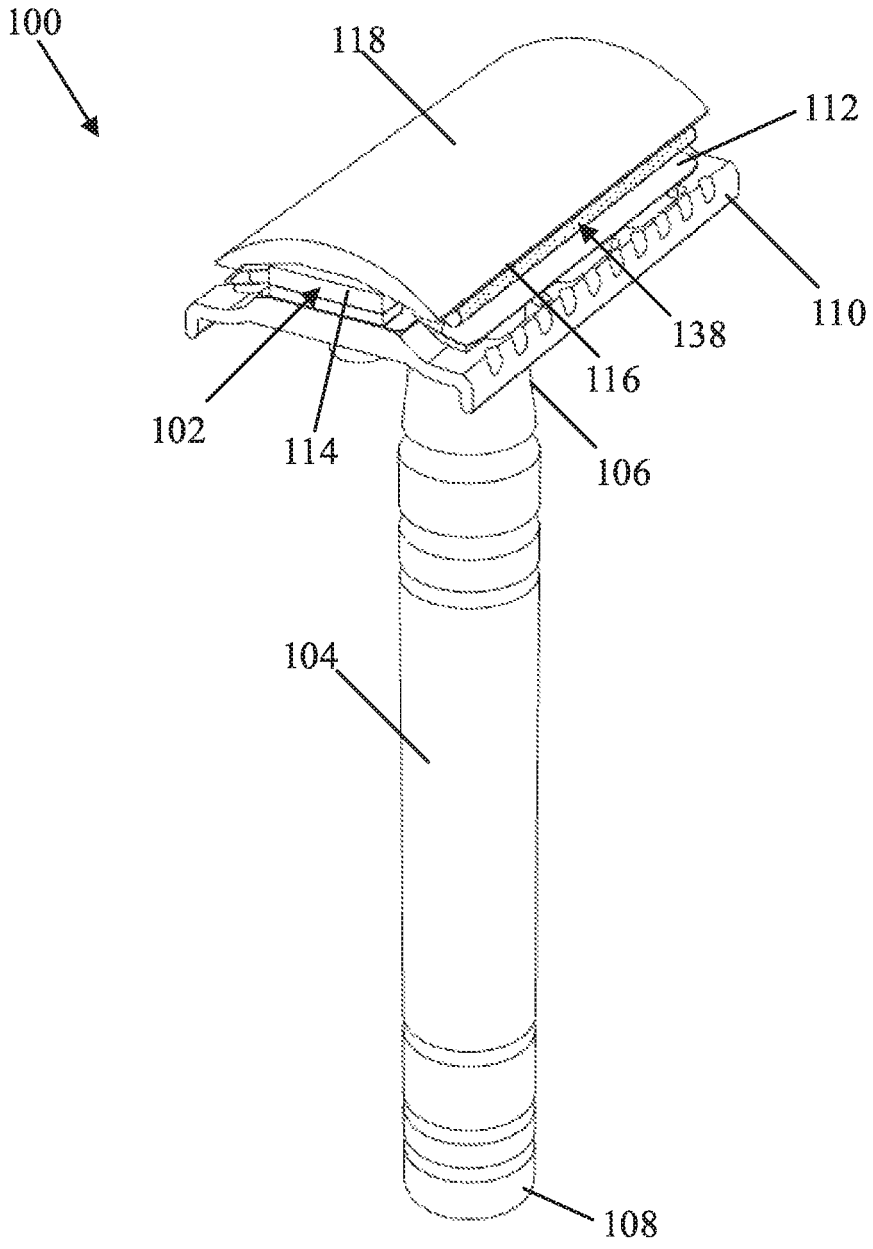
FIG. 1 is a perspective view of an exemplary embodiment of a safety razor.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. For example, the features of safety razor 100 can be combined with features of safety razor 200, and vice versa. The methods, apparatuses, and systems are not limited to any specific aspect or feature or combination thereof, nor do the disclosed embodiments require that any one or more specific advantages be present or problems be solved.

Integers, characteristics, materials, and other features described in conjunction with a particular aspect, embodiment, or example of the disclosed technology are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The disclosed technology is not restricted to the details of any foregoing embodiments. The disclosure extends to any novel one, or any novel combination, of the features disclosed in this specification (including any accompanying claims, abstract and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the terms "a", "an", and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A", "B,", "C", "A and B", "A and C", "B and C", or "A, B, and C."

As used herein, the term "coupled" generally means physically coupled or linked and does not exclude the presence of intermediate elements between the coupled items absent specific contrary language.

Described herein are embodiments of safety razors, as well as lubrication devices and systems for safety razors, comprising at least one lubrication member. These lubrication members can be used to lubricate a user's skin while shaving and to reduce friction and skin irritation caused by a blade during shaving.

In some embodiments, a safety razor can comprise one lubrication member. In some of those embodiments, the lubrication member can be disposed above the blade. In other such embodiments, the lubrication member can be disposed below the blade.

In other embodiments, a safety razor can comprise more than one lubrication member. For example, in some of those embodiments, a safety razor can comprise a first lubrication member disposed above the blade and a second lubrication member disposed below the blade. In other such embodiments, a safety razor can comprise more than two lubrication members (e.g., three, four, five, six, etc.).

It should be noted that although illustrated embodiments are directed toward double-edge ("DE") safety razors (i.e., safety razors with double-edge blades), single-edge ("SE") safety razors (i.e., safety razors with single-edge blades) can be used.

FIGS. 1-6 show a DE safety razor 100, according to one exemplary embodiment. Referring first to FIG. 1, the safety razor 100 can comprise two main components: a head portion 102 and a handle portion 104. The head portion 102 can be removably coupled to a first end 106 of the handle portion 106 and can be perpendicular, or at least substantially perpendicular, to a longitudinal axis of the handle portion 104 which extends from the first end 106 to a second end 108 of the handle portion 104.

Figure 6:
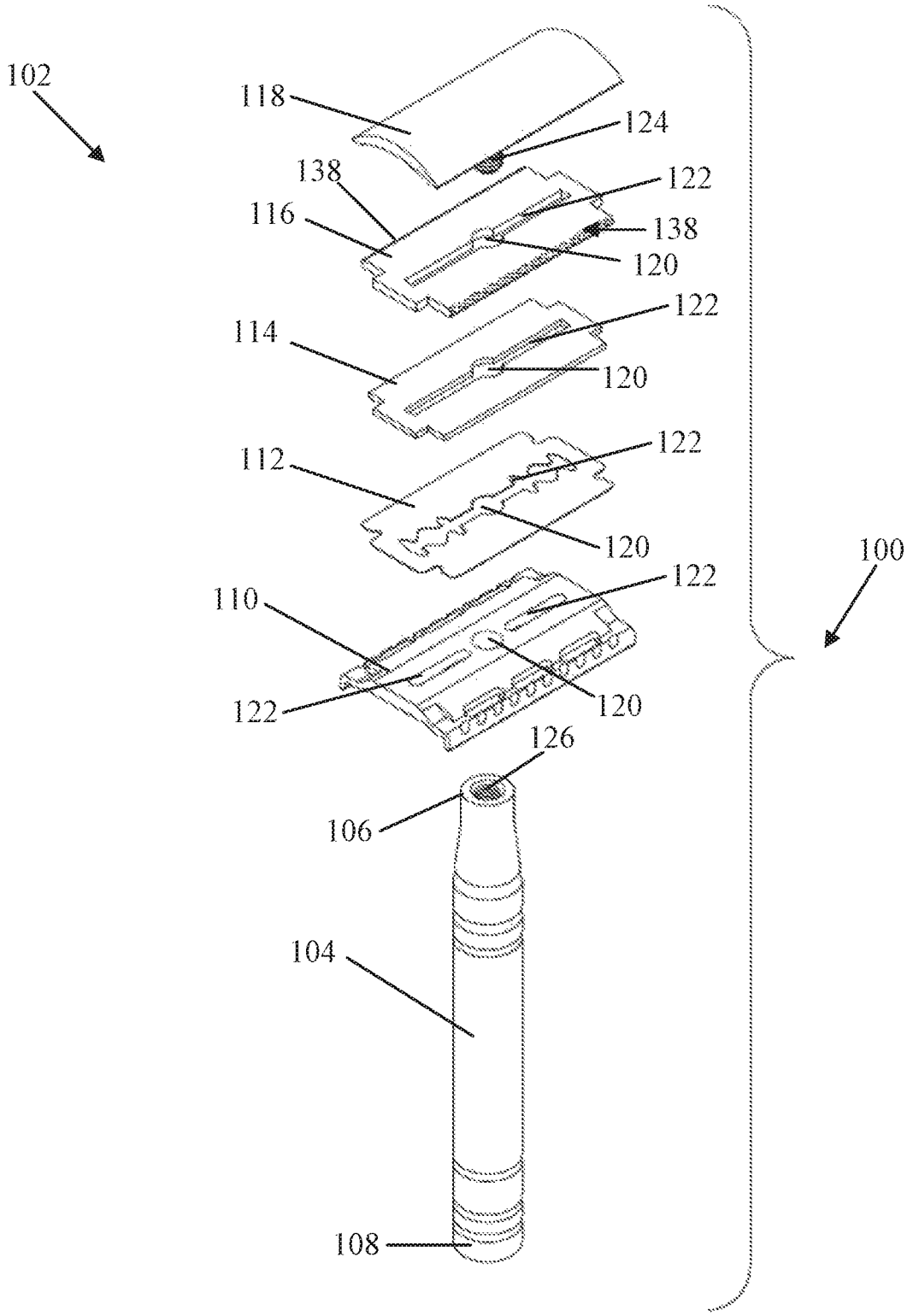
FIG. 6 is an exploded view of the safety razor of FIG. 1.

Referring to FIG. 6, the head portion 102 of the safety razor 100 can comprise a guard member 110, a blade member 112, a spacer member 114, a lubrication member 116, and a cap member 118 (collectively referred to as "the components of the head portion 102"). The components of the head portion 102 can be arranged in various ways. For example, referring to FIG. 2, the guard member 110 can be disposed on the bottom of the head portion 102, adjacent the handle portion 104, and then moving from the bottom of the head portion 102 toward the top of the head portion 102 (i.e., upward as illustrated in FIG. 2), the blade member 112 can be disposed above the guard member 110, the spacer member 114 can be disposed above the blade member 112, the lubrication member 116 can be disposed above the spacer member 114, and the cap member 118 can be disposed above the lubrication member 116 at the top of the head portion 102.

Figure 2:
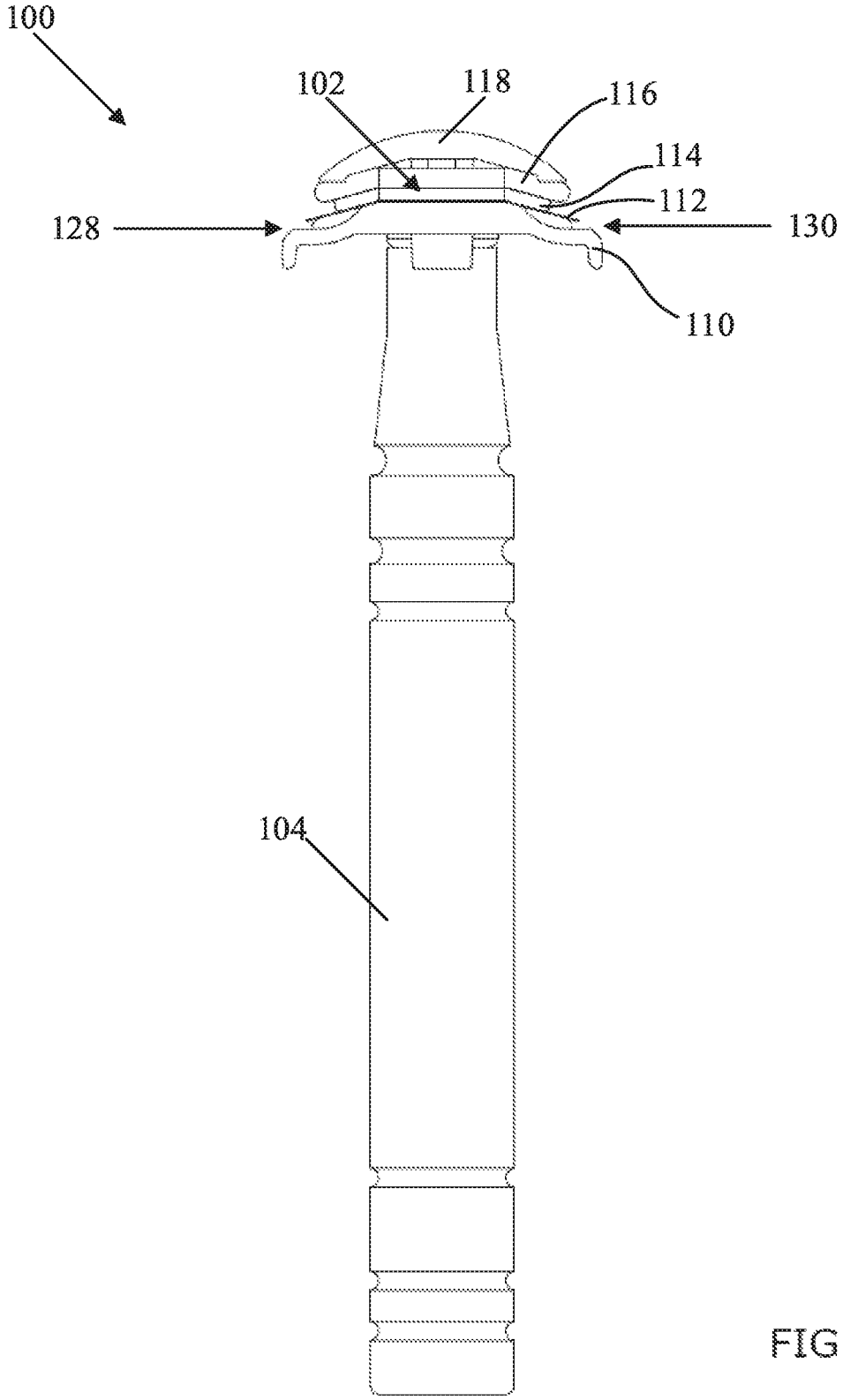
FIG. 2 is an end view of the safety razor of FIG. 1.

Referring still to FIG. 2, the components of the head portion 102 can comprise various dimensions in the lateral direction (i.e., the distance between first and second sides 128, 130 of the respective components of the head portion 102). For example, as shown in the illustrated embodiment, the guard member 110 can be laterally larger than the blade member 112, the spacer member 114, the lubrication member 116, and the cap member 114. The blade member 112 can be laterally larger than the spacer member 114, the lubrication member 116, and the cap member 114. The lubrication member 116 can be laterally larger than the spacer member 114 and the cap member 114. The cap member 118 can be laterally larger than the spacer member 114.

In other embodiments, the lubrication member 116 can be disposed below the blade member 112, and the spacer member 114 can be disposed above the lubrication member 114 and below the blade member 112. In such embodiments, the guard member 110 can be laterally larger than the blade member 112, the spacer member 114, the lubrication member 116, and the cap member 114. The lubrication member 116 can be laterally larger than the spacer member 114, the blade member 112, and the cap member 114. The blade member 112 can be laterally larger than the spacer member 114 and the cap member 114. The cap member 118 can be laterally larger than the spacer member 114.

Figure 5:
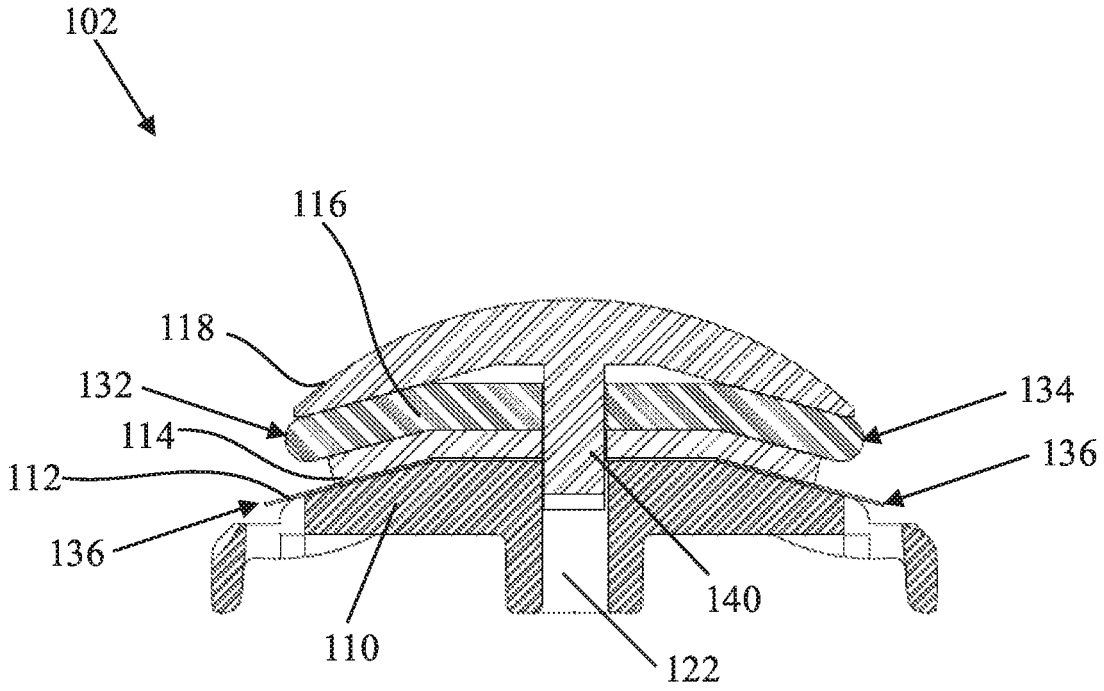
FIG. 5 is a cross-sectional view of the safety razor of FIG. 1, taken along the line 5-5 as shown in FIG. 3.

Referring to FIG. 5, the lubrication member 116 can have first and second edge portions 132, 134. The first and second edge portions 132, 134 can be parallel, or at least substantially parallel, to cutting edge portions 136 of the blade member 112 such that the first and second edges 132, 134 can contact a user's skin when a cutting edge portion 136 of the blade member 112 contacts the user's skin. The first and second edge portions 132, 134 can comprise various configurations (e.g., flat, rounded, angled, etc.). For example, as shown in the illustrated embodiment, the first and second edge portions 132, 134 can be rounded edges, which allows the first and second edge portions 132, 134 to contact the user's skin at various angles.

The lubrication member 116 can be formed of various materials, including polymers, metals, etc. In some embodiments, the lubrication member 116 can be relatively rigid such that the lubrication member 116 can maintain its shape when a user presses the lubrication member 116 against the user's skin. In yet other embodiments, the lubrication member 116 can be relatively flexible such that the lubrication member 116 can bend or flex when a user presses the lubrication member 116 against the user's skin.

Figure 3:
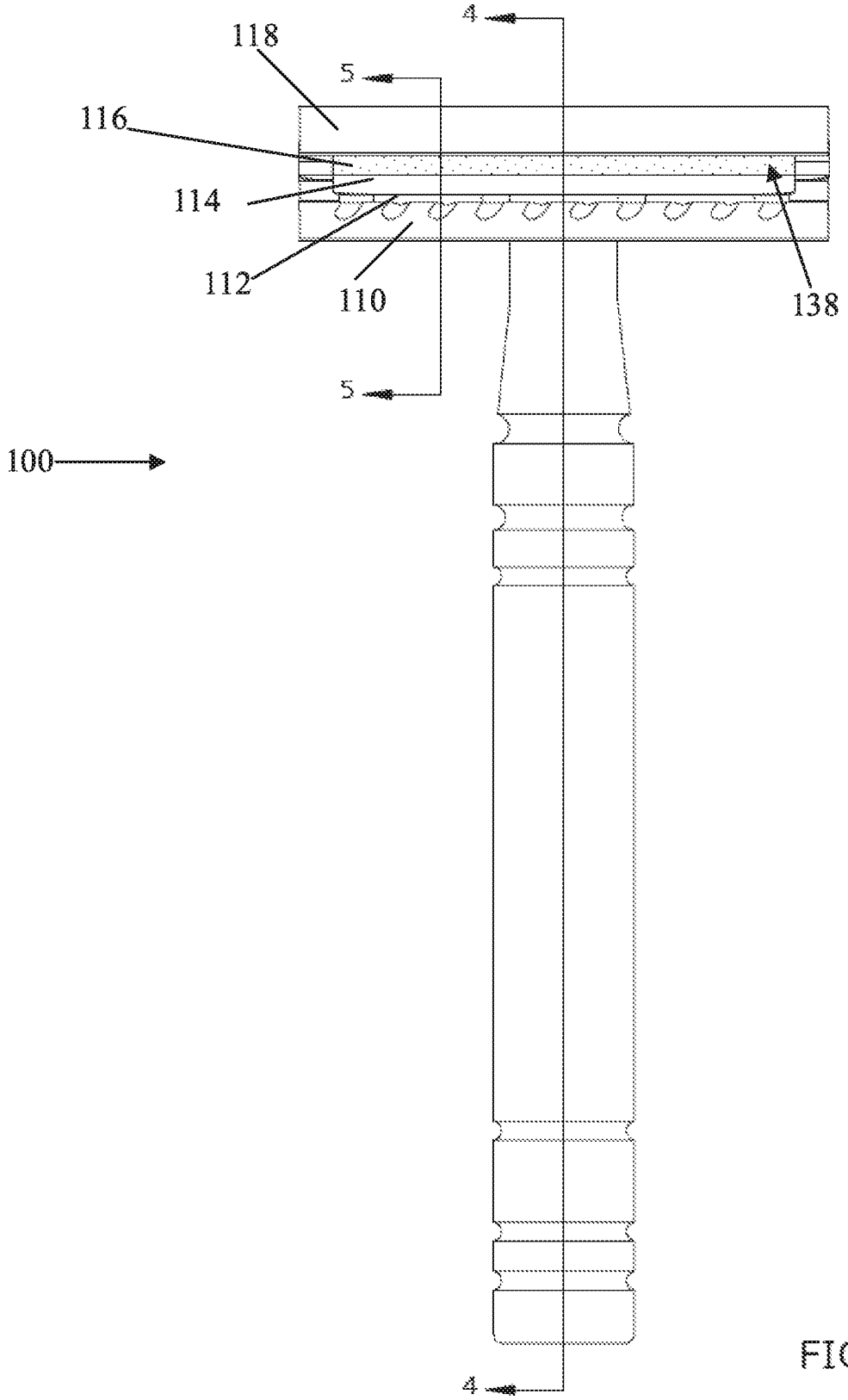
FIG. 3 is a side view of the safety razor of FIG. 1.

The lubrication member 116 can comprise a lubricating substance 138 which can, for example, be attached to the first and second edge portions 132, 134 of the lubrication member 116, as best shown in FIGS. 1, 3, and 6. For example, in some embodiments, the lubricating substance 138 can be a coating that is applied to the surface of the lubrication member 116. In other embodiments, the lubricating substance 138 can be applied to a lubrication strip that is attached to the lubrication member 116 (e.g., with an adhesive). In yet other embodiments, the lubricating substance 138 can be applied to an insert that clips, snaps, slides, and/or is otherwise removably coupled to the lubrication member 116.

The lubricating substance 138 can be formed from various materials, such as polyethylene oxide. The lubricating substance 138 can be configured to lubricate the user's skin as the user moves the safety razor 100 along the user's skin, thereby reducing the resistance (e.g., drag) of the safety razor 100 on the user's skin. This in turn can advantageously reduce skin irritation caused by the cutting edge portion 136 of the blade member pressing against and moving along the user's skin. Additional information regarding lubricants that can be used as lubricating substance 138 can be found, for example, in U.S. Pat. Nos. 5,454,164, 4,872,263, and 4,170,821, which are incorporated herein by reference.

The spacer member 114 can be formed of various materials, including polymers, metals, etc. In some embodiments, the spacer member 114 and the lubrication member 116 can be integrally formed as a single, unitary piece. In other embodiments, the spacer member 114 and the lubrication member can be formed as separate pieces which are fixedly secured together (e.g., with an adhesive, fasteners, etc.). In other embodiments, the spacer member 114 and the lubrication member 116 can be formed as separate piece that are removably coupled together (e.g., with the cap member 118 as further described below).

Figure 4:
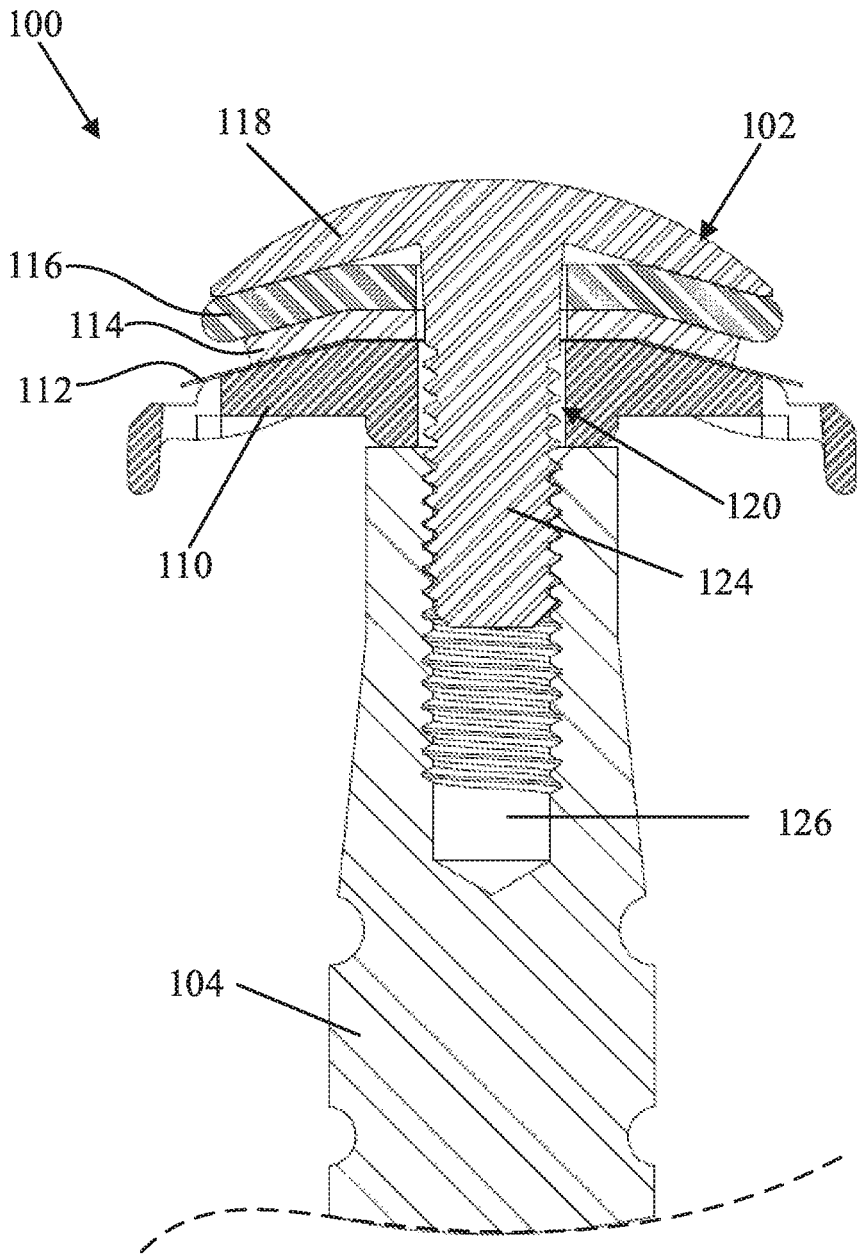
FIG. 4 is a partial cross-sectional view of the safety razor of FIG. 1, taken along the line 4-4 as shown in FIG. 3.

The components of the head portion 102 can include mating features configured to align and to prevent relative movement of the components of the head portion 102 when the head portion 102 is removably coupled to the handle portion 104. For example, referring again to FIG. 6, the guard member 110, the blade member 112, the spacer member 114, and the lubrication member 116 can include centrally disposed openings 120 and one or more slots 122 disposed adjacent and/or extending from the openings 120. Referring now to FIG. 4, the cap member 118 can include a centrally disposed projection 124 that extends from a bottom portion of the cap member 118. The projection 124 of the cap member 118 can be configured to extend through the openings 120 of the lubrication member 116, the spacer member 114, the blade member 112, and the guard member 110, and to extend into a recess 126 formed in the first end portion 106 of the handle portion 104. Referring now to FIG. 5, the cap member 118 also can include at least one tab or ridge 140 that extends from a bottom portion of the cap member 118, adjacent the projection 124. The tab 140 can be configured to extend through the openings 122 of the lubrication member 116, the spacer member 114, the blade member 112, and the guard member 110. In this manner, the projection 124 and the tab 140 of the cap member 118 can respectively engage the openings 120 and the slots 122 of the lubrication member 116, the spacer member 114, the blade member 112, and the guard member 110, thereby aligning and preventing relative movement of the components of the head portion 102 when the head portion 102 is coupled to the handle portion 104.

The projection 124 of the cap member 118 can also be used to removably couple the head portion 102 to the handle portion 104. For example, as shown in FIG. 4, the projection 124 of the cap member 118 can include external threads that are configured to engage corresponding internal threads formed in the recess 126 of the handle portion 104. In such embodiments, the safety razor 100 can be assembled by inserting the projection 124 of the cap member 118 through the components of the head portion 102 and into the recess 126 of the handle portion 104 and by rotating the handle portion 104 in a first direction (e.g., clockwise) relative to the head portion 102 until the head portion 102 is firmly secured to the handle portion 104. The safety razor 100 can be disassembled by rotating the handle portion 104 in a second direction (e.g., counterclockwise) relative to the head portion 102 until the head portion 102 is released from the handle portion 104.

In other embodiments, the head portion 102 can be removably coupled to the handle portion 104 in various other ways, including a snap-fit type connection, fasteners (e.g., bolts or screws), etc.

Figure 7:
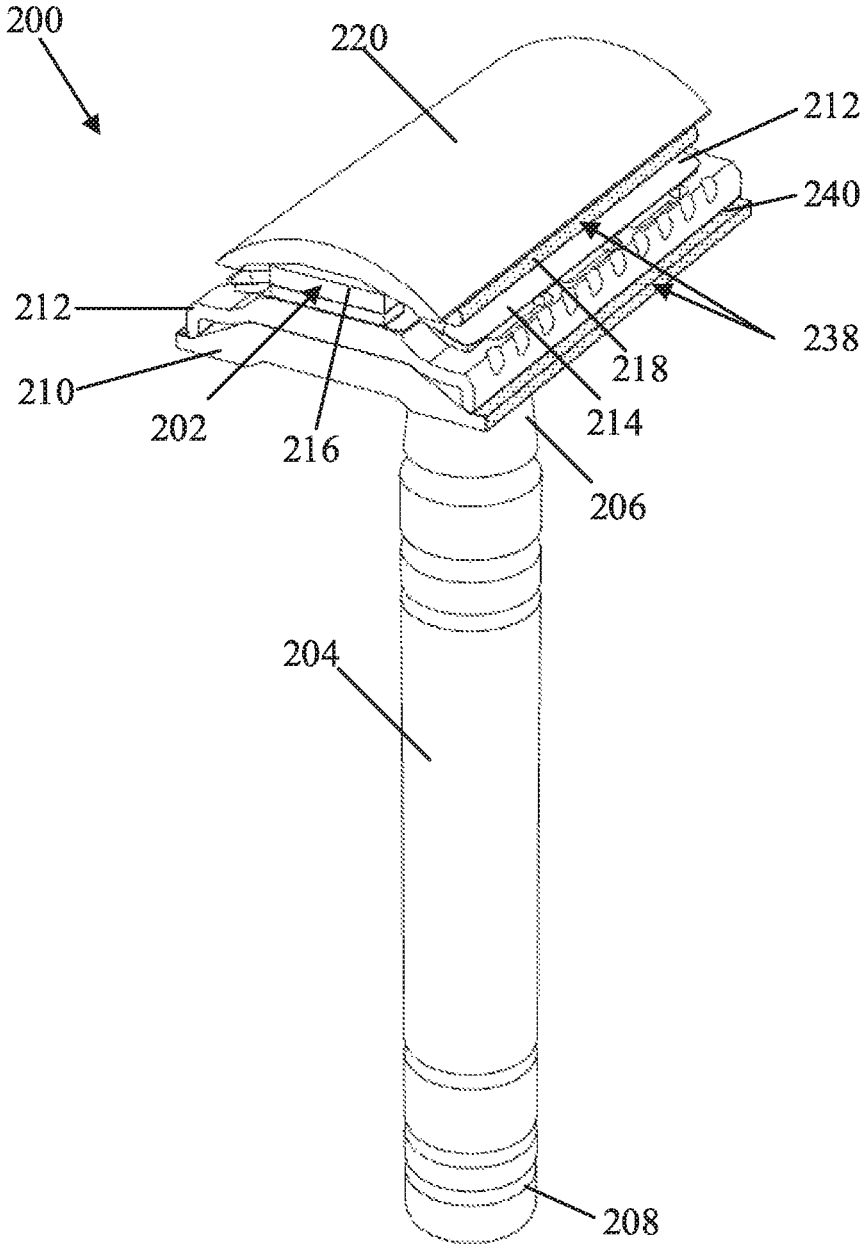
FIG. 7 is a perspective view of another exemplary embodiment of a safety razor.

FIGS. 7-12 show a DE safety razor 200, according to another exemplary embodiment. Referring first to FIG. 7, the safety razor 200 can comprise two main components: a head portion 202 and a handle portion 204. The head portion 202 can be removably coupled to a first end 206 of the handle portion 204 and can be perpendicular, or at least substantially perpendicular, to a longitudinal axis of the handle portion 204 which extends from the first end 206 to a second end 208 of the handle portion 204.

Figure 12:
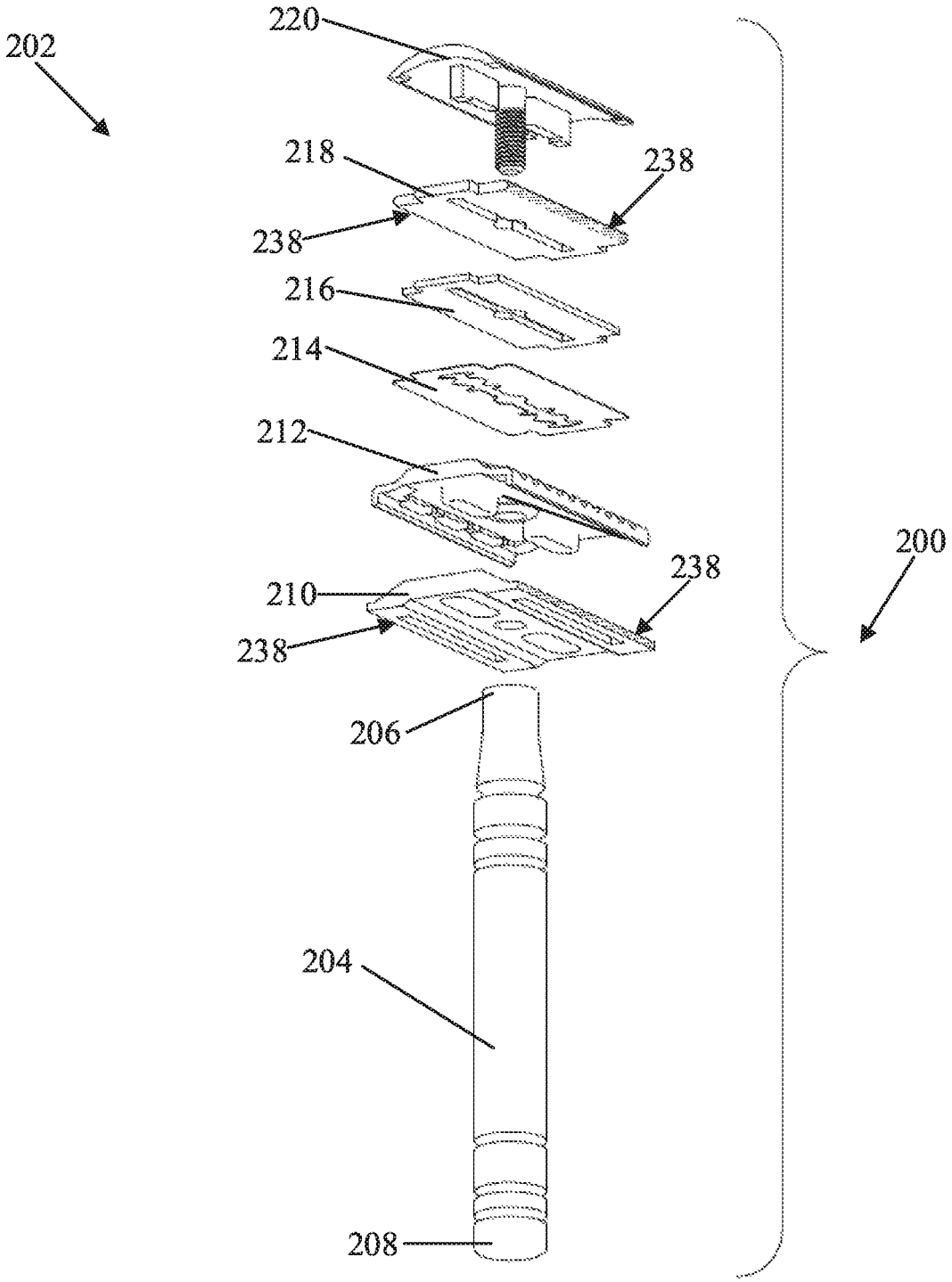
FIG. 12 is an exploded view of the safety razor of FIG. 7.

Referring to FIG. 12, the head portion 202 of the safety razor 200 can comprise a first lubrication member 210, a guard member 212, a blade member 214, a spacer member 216, a second lubrication member 218, and a cap member 220 (collectively referred to as "the components of the head portion 202"). The components of the head portion 202 can be arranged in various ways. For example, referring to FIG. 8, the first lubrication member 210 can be disposed on the bottom of the head portion 202 adjacent the handle portion 204, and then moving from the bottom of the head portion 202 toward the top of the head portion 202 (i.e., upward as illustrated in FIG. 8), the guard member 212 can be disposed above the first lubrication member 210, the blade member 214 can be disposed above the guard member 212, the spacer member 216 can be disposed above the blade member 214, the second lubrication member 218 can be disposed above the spacer member 216, and the cap member 220 can be disposed above the second lubrication member 218 at the top of the head portion 102.

Figure 8:
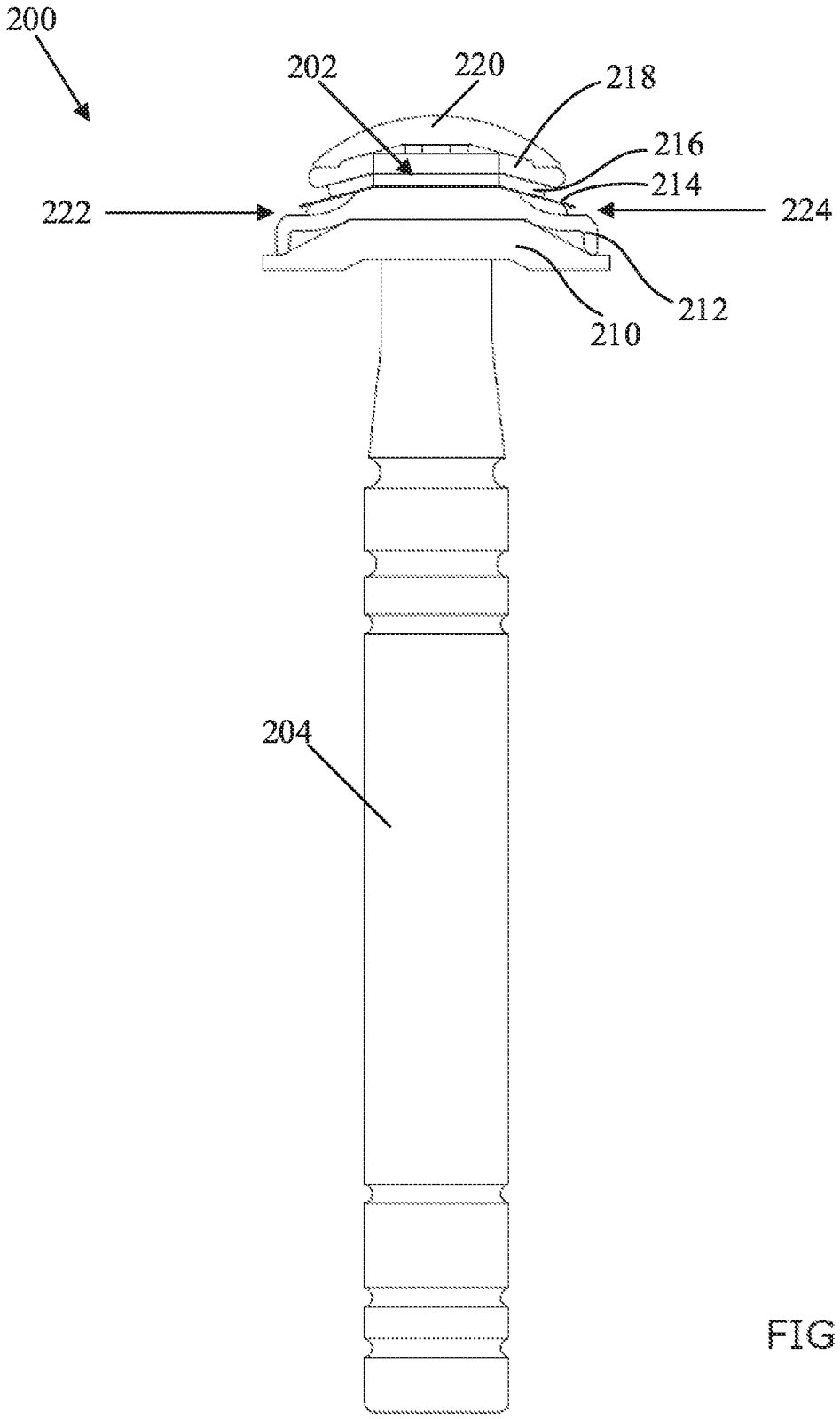
FIG. 8 is an end view of the safety razor of FIG. 7.

Referring still to FIG. 8, the components of the head portion 102 can comprise various dimensions in the lateral direction (i.e., the distance between first and second sides 222, 224 of the respective components of the head portion 202). For example, as shown in the illustrated embodiment, the first lubrication member 210 can be laterally larger than the guard member 212, the blade member 214, the spacer member 216, the second lubrication member 218, and the cap member 220. The guard member 212 can be laterally larger than the blade member 214, the spacer member 216, the second lubrication member 218, and the cap member 220. The blade member 214 can be laterally larger than the spacer member 216, the second lubrication member 218, and the cap member 220. The cap member 220 can be laterally larger than the spacer member 216.

In other embodiments, the first lubrication member 210 and/or the second lubrication member 218 can be disposed above the guard member 212 and below the blade member 214. In such embodiments, the guard member 212 can be laterally larger than the first and/or second lubrication member 210, 218, the blade member 214, the spacer member 216, and the cap member 220. The first and/or second lubrication members 210, 218 can be laterally larger than the blade member 214, the spacer member 216, and the cap member 220. The blade member 214 can be laterally larger than the spacer member 216, and the cap member 220. The cap member 220 can be laterally larger than the spacer member 216. In some embodiments, one or more additional spacer members (e.g., similar to spacer member 216) can be disposed between the first and/or second lubrication members 210, 218 and/or the blade member 214.

Although not shown, in other embodiments, the safety razor 200 can comprise more than two lubrication members. For example, the safety razor 200 can include a third lubrication member. In one particular embodiment, the third lubrication member can, for example, be disposed between the guard member 212 and the blade member 214. The third lubrication member can be spaced relative to the blade member 214 by a spacer member (e.g., similar to spacer member 216).

Additionally or alternatively, the safety razor 200 can include one or more additional lubrication members adjacent to any and/or all of the lubrications members. For example, two additional lubrications can be disposed adjacent the second lubrication member 218 to form a "stack" or "series" of three lubrication members. In some of such embodiments, each lubrication member in the stack can abut an adjacent lubrication member. In other such embodiments, each lubrication member can be spaced relative to an adjacent lubrication member by a spacer member (e.g., similar to spacer member 216).

In some embodiments, the lubrication members can be tapered in the lateral direction relative to each other. In other words, each lubrication member can be at least slightly laterally larger than the lubrication members disposed above it and at least slightly smaller than the lubrication members disposed below it. The angle or amount of taper of the lubrication members can vary. In some embodiments, the angle of taper of the lubrication members can, for example, follow (at least generally) the taper of the other components of the head portion 202. In some embodiments, the angle of taper can be from about 0 degrees to about 60 degrees relative to the longitudinal axis of the handle portion. In particular embodiments, the angle of taper can be from about 20 degrees to about 40 degrees. In one particular embodiment, the angle of taper can be about 30 degrees. Tapering the lubrication members in this manner can, for example, allow each lubrication member to contact the user's skin when the safety razor 200 is angled against the user's skin during shaving.

Figure 11:
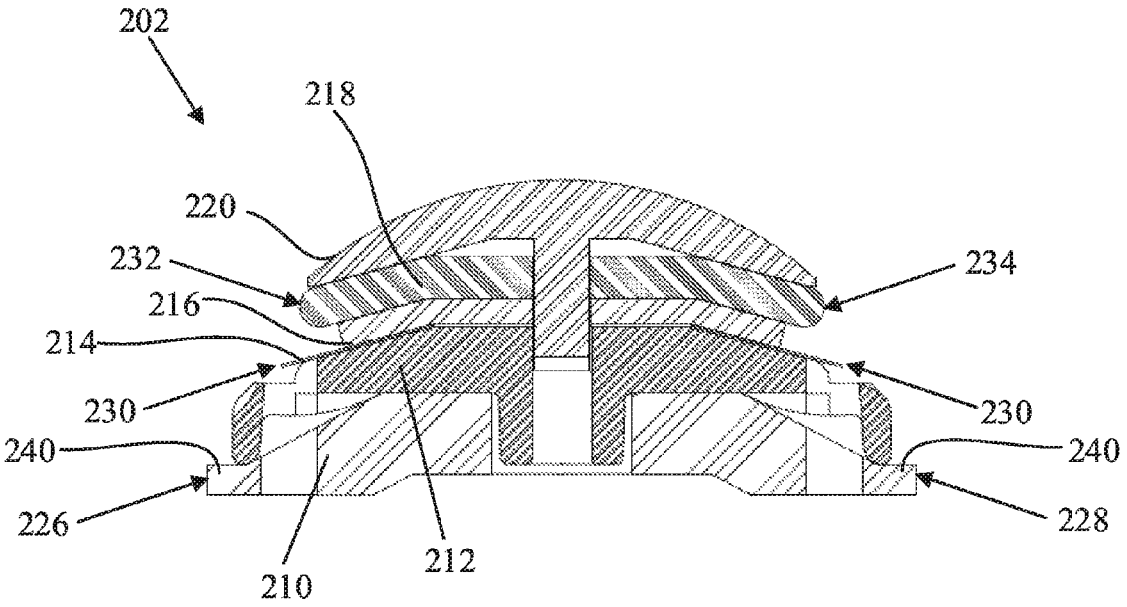
FIG. 11 is a cross-sectional view of the safety razor of FIG. 7, taken along the line 11-11 as shown in FIG. 9.

Referring to FIG. 11, the first lubrication member 210 can have first and second edge portions 226, 228. The first and second edge portions 226, 228 can be parallel, or at least substantially parallel, to cutting edge portions 230 of the blade member 214 such that the first and second edges 226, 228 can contact a user's skin when a cutting edge portion 230 of the blade member contacts the user's skin. The first and second edge portions 226, 228 can comprised various configurations (e.g., flat, rounded, angled, etc.). As shown, in some embodiments, the first and second edge portions 226, 228 can be flat. Although not shown, in other embodiments, the first and second edge portions 226, 228 can be rounded (e.g., in a manner similar to first and second edge portions 232, 234 of the second lubrication member 218), which allows the first and second edge portions 226, 228 to contact the user's skin at various angles.

The second lubrication member 218 can have first and second edge portions 232, 234. The first and second edge portions 232, 234 can be parallel, or at least substantially parallel, to cutting edge portions 230 of the blade member 214 such that the first and second edges 232, 234 can contact a user's skin when a cutting edge portion 230 of the blade member 214 contacts the user's skin. The first and second edge portions 232, 234 can comprised various configurations (e.g., flat, rounded, angled, etc.). As shown, in one particular embodiment, the first and second edge portions 232, 234 can be rounded.

Figure 9:
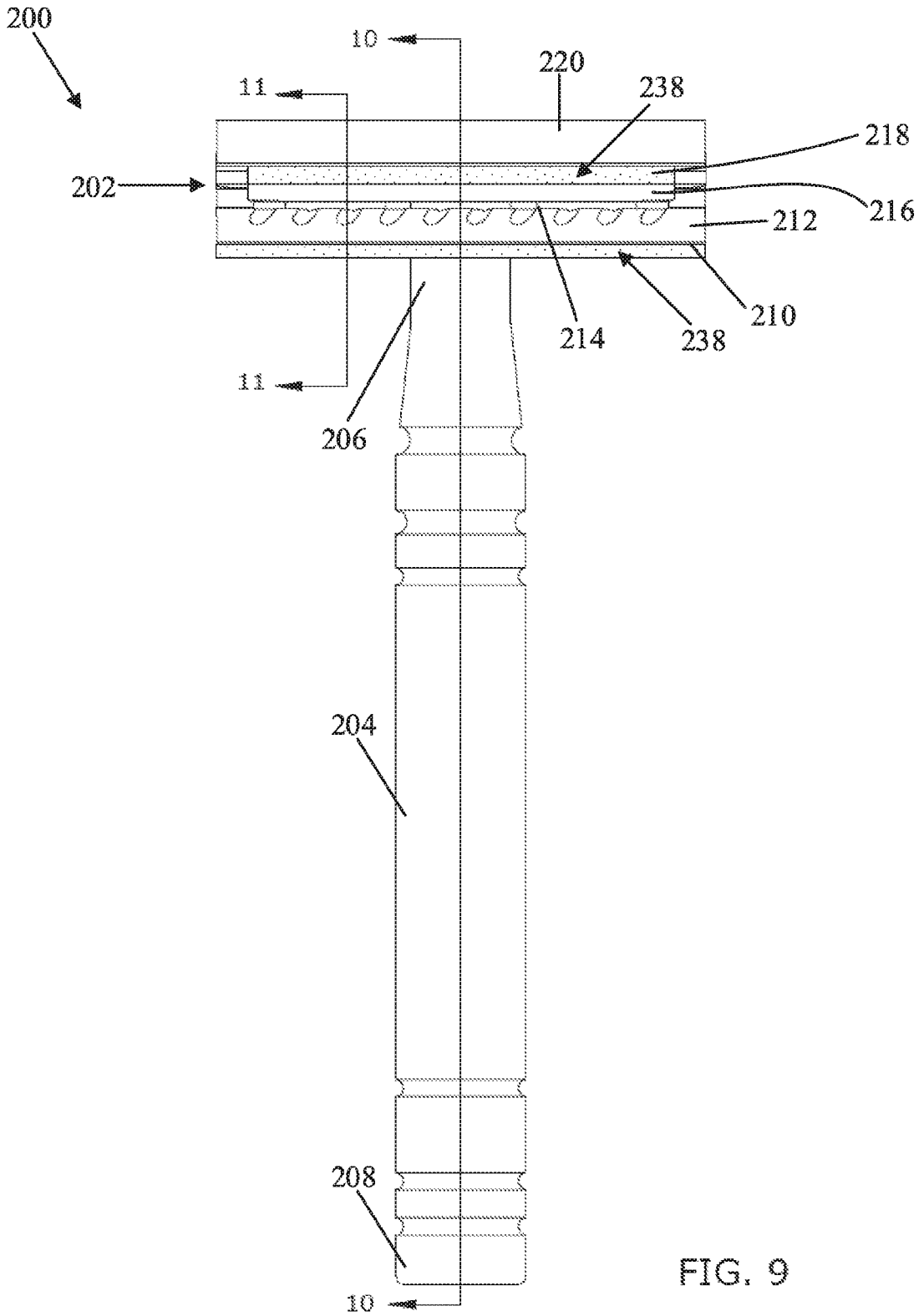
FIG. 9 is a side view of the safety razor of FIG. 7.
Figure 10:
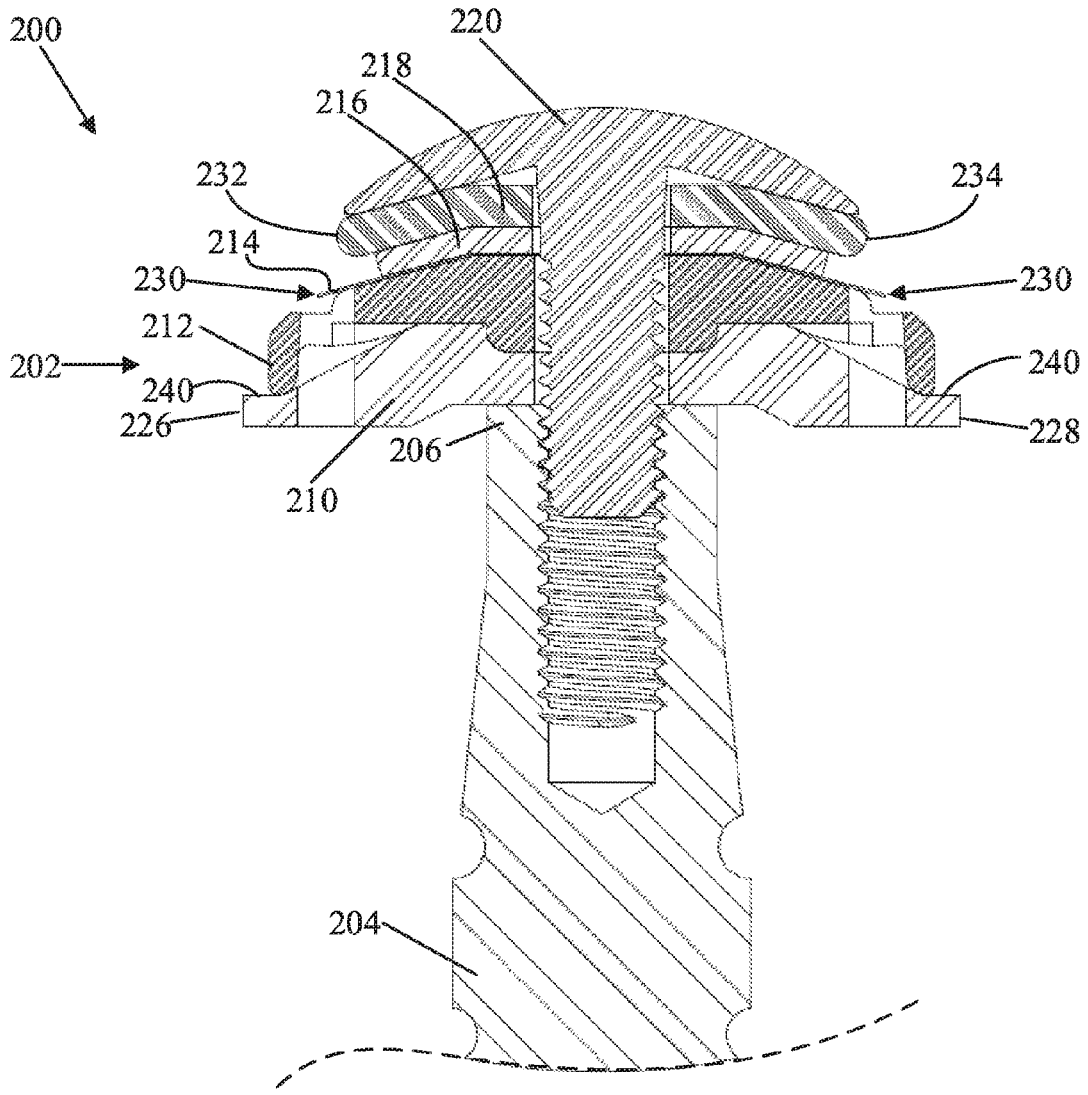
FIG. 10 is a partial cross-sectional view of the safety razor of FIG. 7, taken along the line 10-10 as shown in FIG. 9.

The first and second lubrication members 210, 218 can be formed of various materials, including polymers, metals, etc. The first and second lubrication members 210, 218 can comprise a lubricating substance 238 which can, for example, be attached and/or applied to the first and second edge portions 226, 228, 232, 234 of the first and second lubrication members 210, 218, as best shown in FIGS. 7, 9, and 12. For example, in some embodiments, the lubricating substance 138 can be a coating that is applied to the surface of the lubrication member 116. In other embodiments, the lubricating substance 138 can be applied to a lubrication strip that is attached to the lubrication member 116 (e.g., with an adhesive). In yet other embodiments, the lubricating substance 138 can be applied to an insert that clips, snaps, slides, and/or is otherwise removably coupled to the lubrication member 116.

The lubricating substance can also be attached or applied to various other portions of the first and second lubrication members 210, 218. For example, as shown in FIG. 7, the lubricating substance 238 can be attached and/or applied to an upwardly facing surface 240 of the first lubrication member 210.

The lubricating substance 238 can be formed from various materials, such as polyethylene oxide. The lubricating substance 238 can be configured to lubricate the user's skin as the user moves the safety razor 100 along the user's skin, thereby reducing the resistance (e.g., drag) of the safety razor 200 on the user's skin. This in turn can advantageously reduce skin irritation caused by the cutting edge portion 136 of the blade member pressing against and moving along the user's skin.

The components of the head portion 202 can include mating features configured to align and to prevent relative movement of the components when the head portion 202 is coupled to the handle portion 202, for example, in a manner similar to the safety razor 100. The head portion 202 and the handle portion 204 can be removably coupled together, for example, in a manner similar to the safety razor 100.

In some embodiments, various components of the safety razors 100, 200 (e.g., lubrications members 116, 210, 218, spacers 114, 216, caps 118, 220, etc.) can be a separate lubrication device and/or system that can be configured to be used with various other safety razors. For example, the lubrication member 116, the spacer 114, and the cap 118 can be a lubrication system configured to be removably coupled to a safety razor that does not have a lubrication system and/or that has different lubrication system. This advantageously allows a user to selectively interchange and/or exchange each component as desired.

Configuring a safety razor (e.g., safety razors 100, 200) and/or a lubrication system as described herein can advantageously allow a user to independently remove and/or replace each component of the head portion (e.g., the head portion 102) and/or the handle portion (e.g., the handle portion 104) of the safety razor as desired. For example, a user can exchange a dull blade member for a new blade member and can continue to use the lubrication member if there is an unused portion of the lubricating substance on the lubrication member. As another example, a user can exchange the lubrication member for a new lubrication member and can continue to use the blade member if the blade member is still sufficiently sharp. The safety razors and lubrication systems described herein are therefore relatively more economical and less wasteful than typical cartridge razors which require a user to exchange the entire head portion when only a single component (e.g., the blade member) needs to be replaced.

In addition, the safety razors and lubrication systems described herein can also significantly improve typical safety razors by providing lubrication members and lubricating substances for a safety razor which can, for example, advantageously improve the closeness and/or comfort of a shave compared to typical safety razors.

In view of the many possible embodiments to which the principles of the present disclosure may be applied, it should be recognized that the illustrated embodiments are only preferred examples and should not be taken as limiting the scope of the disclosure. Rather, the scope of the present disclosure is defined by the following claims. I therefore claim all that comes within the scope and spirit of these claims.

I claim:

1. A safety razor, comprising:

a handle portion having a first end portion and a second end portion and a longitudinal axis extending from the first end portion to the second end portion; and a head portion which includes:

a guard member;

only one replaceable blade member having a first cutting edge portion and a second cutting edge portion, wherein the first and second cutting edge portions are laterally spaced;

a spacer member having first and second side surfaces;

a replaceable lubrication member comprising first and second lubrication strips attached thereto, wherein each lubrication strip has a lubrication substance applied thereon, and wherein the first lubrication strip is disposed adjacent the first cutting edge portion of the blade member, and the second lubrication strip is disposed adjacent the second cutting edge portion of the blade member; and a cap member having a projection and a tab, wherein the projection is configured to extend through the lubrication member, the spacer member, the blade member, and the guard member and to extend into the first end portion of the handle portion, thereby removably coupling the head portion to the handle portion, and wherein the tab is disposed adjacent the projection and extends through the lubrication member, the spacer member, the blade member, and the guard member, thereby preventing relative rotational movement between the lubrication member, the blade member, and the guard member, wherein the spacer member is disposed axially between and contacts the blade member and the lubrication member, wherein the lubrication member is disposed axially between the spacer member and the cap member, and wherein the first and second cutting edge portions of the blade member and the first and second lubrication strips of the lubrication member extend laterally beyond the first and second side surfaces of the spacer member and the cap member, wherein the lubrication member, the spacer member, the blade member, and the guard member have centrally disposed openings through which the projection of the cap member extends when the head portion is coupled to the handle portion, wherein the lubrication member, the spacer member, the blade member, and the guard member have slots disposed adjacent the centrally disposed openings through which the tab of the cap member extends when the head portion is coupled to the handle portion, and wherein the head portion is configured such that the blade member and the lubrication member are independently replaceable relative to each other, the guard member, and the cap member when the head portion is removed from the handle portion.

2. The safety razor of claim 1, wherein the lubrication member is rigid such that the lubrication member maintains its shape when a user presses the lubrication member against the user's skin.

3. The safety razor of claim 1, wherein the lubrication member has rounded edge portions that extends laterally beyond the cap member, and the first and second lubrication strips are disposed on the rounded edge portions of the lubrication member.

4. The safety razor of claim 1, wherein the lubrication substance is a lubricating coating.

5. The safety razor of claim 1, wherein the first cutting edge portion is disposed on a first side portion of the blade member, the second cutting edge portion is disposed on a second side portion of the blade member, and the head portion is removably coupled to the handle portion such that the first and second cutting edge portions are perpendicular to the longitudinal axis of the handle portion, and wherein the lubrication member has a first edge portion disposed on a first side portion of the lubrication member and a second edge portion disposed on a second side portion of the lubrication member, and the first and the second edge portions of the lubrication member are parallel to the first and second cutting edge portions of the blade member, and wherein the first lubrication strip is attached to the first edge portion of the lubrication member, and the second lubrication strip is attached to the second edge portion of the lubrication member.

6. The safety razor of claim 1, wherein a portion of the lubrication member to which the first and second lubrication strips are attached directly contacts the cap member.

7. The safety razor of claim 1, wherein the first and second cutting edge portions of the blade member extend laterally beyond the lubrication member.

8. The safety razor of claim 1, wherein the lubrication substance is a supplementary lubrication substance configured to be used in conjunction with a shaving cream.

9. The safety razor of claim 1, wherein the lubrication substance is configured to be used in lieu of a shaving cream.

10. The safety razor of claim 1, wherein the first and second lubrication strips are attached to the lubrication member with an adhesive.

11. The safety razor of claim 1, wherein the blade member and the lubrication member comprise the same cross-sectional shape taken in planes perpendicular to the longitudinal axis of the handle portion.

* * * * *